US006002335A

United States Patent [19]

Zarembo et al.

[11] Patent Number: 6,002,335

[45] Date of Patent: Dec. 14, 1999

[54] SMALL MAGNET RESENSITIZER APPARATUS FOR USE WITH ARTICLE SURVEILLANCE SYSTEMS

[75] Inventors: Peter J. Zarembo, Shoreview; Erland K. Persson, Golden Valley, both of Minn.

[73] Assignee: 3M Innovative Properties Company, St. Paul, Minn.

[21] Appl. No.: 09/026,251

[22] Filed: Feb. 18, 1998

[51] Int. Cl.[6] ..... G08B 13/14

[52] U.S. Cl. ..... 340/572.1; 340/572.3; 340/572.4

[58] Field of Search ..... 340/551, 572, 340/572.1, 572.2, 572.3, 572.4, 572.5, 572.6, 572.7, 552; 335/284

[56] References Cited

U.S. PATENT DOCUMENTS

| | | | |
|---|---|---|---|
| 3,665,449 | 5/1972 | Elder et al. | 340/572 |
| 3,747,086 | 7/1973 | Peterson | 340/572 |
| 3,790,945 | 2/1974 | Fearon | 340/572 |
| 4,086,519 | 4/1978 | Persson | 318/254 |
| 4,689,590 | 8/1987 | Heltemes | 335/284 |
| 4,710,754 | 12/1987 | Montean | 340/572 |
| 4,745,401 | 5/1988 | Montean | 340/572 |
| 4,752,758 | 6/1988 | Heltemes | 335/284 |
| 4,825,197 | 4/1989 | Church et al. | 340/572 |
| 4,884,063 | 11/1989 | Church et al. | 340/572 |
| 4,956,636 | 9/1990 | Sansom et al. | 340/551 |
| 4,967,185 | 10/1990 | Montean | 340/572 |
| 5,083,122 | 1/1992 | Piotrowski et al. | 340/572 |
| 5,331,313 | 7/1994 | Koning | 340/551 |
| 5,399,372 | 3/1995 | Grimes et al. | 427/131 |
| 5,432,499 | 7/1995 | Montean | 340/572 |
| 5,594,420 | 1/1997 | Copeland et al. | 340/572.1 |

FOREIGN PATENT DOCUMENTS

| | | | |
|---|---|---|---|
| 0 129 335 | 12/1984 | European Pat. Off. | G08B 13/24 |
| 0 585 891 | 3/1994 | European Pat. Off. | G08B 13/24 |

*Primary Examiner*—Jeffery A. Hofsass
*Assistant Examiner*—Van T. Trieu
*Attorney, Agent, or Firm*—Peter L. Olson

[57] ABSTRACT

A demagnetization apparatus for use with magnetically based electronic article surveillance systems having a dual status anti-theft marker containing at least one demagnetizable control element which when demagnetized allows the marker to be detected by the system when the marker is present in an interrogation zone. The apparatus includes an elongated magnetic section contained within a housing which exhibits a succession of fields of alternate polarity and at least a portion of which exhibits exponentially decreasing intensities at the working surface of the housing along that portion of the section. The section and a cover plate are orientated such that the external fields near the working surface are sufficient in intensities to demagnetize the demagnetizable element of the marker positioned proximate thereto while being rapidly attenuated a short distance from the section.

37 Claims, 5 Drawing Sheets

SMALL MAGNET RESENSITIZER APPARATUS FOR USE WITH ARTICLE SURVEILLANCE SYSTEMS

TECHNICAL FIELD

The present invention relates to electronic article surveillance (EAS) systems of the type in which a dual status marker, affixed to articles to be protected, causes a detectable signal in response to an alternating magnetic field produced in an interrogation zone. Such a dual status marker may preferably comprise a piece of a high permeability, low coercive force magnetic material and at least one permanently magnetizable control element. When the control element is demagnetized, a signal may be produced when the marker is in the zone, and when magnetized, a different signal corresponding to another state of the marker may be produced. More particularly, the present invention relates to an apparatus for changing the state of such markers.

BACKGROUND OF THE INVENTION

EAS systems of the type described above, are described in U.S. Pat. No. 3,665,449 (Elder and Wright). With such systems, a dual status marker of the type described above may be sensitized, i.e., the high-coercive force control elements thereof demagnetized, by applying an alternating, diminishing amplitude magnetic field, or by gradually removing an alternating field of constant intensity such as by withdrawing a bulk magnetic eraser of the type supplied by Nortronics Company, Inc. of Minneapolis, Minn. As disclosed in the U.S. Pat. No. 3,665,449 such a demagnetization operation may also be effected through the proper selection and arrangement of a series of permanent magnets in which adjacent magnets are oppositely polarized. By selecting the magnets to be of different strengths and by arranging them in an order ranging from highest to lowest (relative to the direction of travel), the magnetic field will appear to diminish in amplitude when passed over a control element. The patent also suggests that magnets of the same field strength may be arranged like inverted ascending steps or like an inclined plane so that the amplitude of the field is progressively diminished to produce the same result, and that it is not ordinarily necessary to demagnetize the control element in the strictest sense. Rather, the magnetic influence of the control element need only be reduced to an extent permitting magnetization reversal of the marker by the applied field.

While such techniques may be useful in many areas with the markers affixed to a wide variety of articles, the magnetic fields associated therewith have been found to unacceptably interfere with magnetic states associated with certain articles, such as prerecorded magnetic video and audio cassettes utilized in video rental businesses and in public libraries. Because of the compact size and popularity of such prerecorded magnetic cassettes, they are frequent targets for shoplifters, and hence likely articles with which anti-theft markers would be used. At the same time however, such affixed markers would be desirably sensitized upon return of the article, and it has been found that prior art demagnetization apparatus such as those described above may unacceptably affect signals prerecorded on the magnetic tapes within the cassettes.

In contrast to the demagnetization apparatus of the art described above in which the intensity of the magnetic fields produced thereby extend in a virtually uncontrolled fashion, the apparatus described in U.S. Pat. No. 4,689,590 (Heltemes) and U.S. Pat. No. 4,752,758 (Heltemes) provides a succession of fields of alternating polarity which rapidly decrease in intensity only a short, controlled distance from the surface of the apparatus and thus, while being capable of demagnetizing high-coercive force control elements of a marker brought close thereto, would be incapable of appreciably interfering with the magnetic signals recorded on tapes within a cassette to which the marker is affixed.

The Heltemes apparatus utilizes an elongated array of closely spaced poles whose field intensity is substantially similar but whose polarity alternates. This array is typically formed using a series of permanently magnetized elements made from the same material and having substantially similar dimensions. The array is positioned at an incline relative to a working surface such that a high-coercive force control element that is moved relative to the array along the working surface in the direction of increasing distance between the array and the working surface experiences a magnetic field that alternates in polarity and generally decreases in intensity. Used in such a manner, the apparatus causes the control element to become demagnetized. Demagnetization in such a manner is often referred to as "ring-down."

While the Heltemes apparatus is useful in demagnetizing control elements contained in anti-theft markers affixed to prerecorded magnetic tapes without affecting the signals prerecorded on such tapes, the array of alternating poles embodied therein is not designed for optimal ring-down. Optimal ring-down occurs when the alternating magnetic field decreases in an exponential envelope. The Heltemes apparatus relies on the gradually, and typically linearly, increasing distance between a working surface and a series of alternating poles of substantially similar strength to achieve decreasing field intensity at the working surface. Consequently, the length of the series of alternating poles in the Heltemes apparatus is significantly longer than necessary for an optimized magnetic array. In addition, because the first and last magnet elements in the array have only one neighboring magnet element of opposite polarity, the contributions from these end elements can be undesirably large, thus leaving the control element with a net magnetization. Correction of this problem also necessitates a longer array in the Heltemes apparatus.

SUMMARY OF THE INVENTION

In contrast to the demagnetization devices discussed above, the apparatus of the present invention provides a series of closely spaced poles that produce an alternating magnetic field optimized to decrease in intensity with every field reversal inside an exponential envelope, thereby being capable of demagnetizing high-coercive force control elements of a marker brought close thereto without interfering with signals recorded on magnetically sensitive media within a cassette to which the marker is affixed, while also eliminating the dependence on distance for field fall-off and the end effects inherent in the Heltemes apparatus that severely limit the ability to shorten and optimize the size of the magnetic array. In addition, the demagnetization apparatus of the present invention requires no power source, sends out no possibly harmful AC fields, and performs without dependence on the speed with which the marker is moved relative to the apparatus.

The apparatus of the present invention is thus adapted for use with an electronic article surveillance (EAS) system for detecting a sensitized dual status anti-theft marker secured to an article, the presence of which within an interrogation zone is desirably known. The apparatus may be adapted for use with such a marker affixed to the outer surface of prerecorded video or audio cassettes or for use with such a marker affixed to non-magnetic media such as library books. The marker in such a system includes a piece of low coercive force, high-permeability ferromagnetic material and at least one control element of a permanently magnetizable high coercive force material positioned proximate to the first material. Such an element, when demagnetized, results in the marker being in a first state, such as, for example, a sensitized state in which the marker may be detected when it is in the interrogation zone. Conversely, when the control element is magnetized, the marker is in a second state, such as, for example, a desensitized state in which the marker is not detected when it is in the zone.

The apparatus of the present invention comprises a housing having a working surface relative to which the article may be moved and an elongated section of a permanent magnetic material associated with the housing. The elongated section has a plurality of poles, and the poles exhibit at the working surface of the housing a succession of fields of alternate polarity whose intensities decrease upon each field reversal within an exponential envelope. Each pole extends across the width of the elongated section and the succession of poles extends along the length of the elongated section. Thus, movement of the article relative to the working surface from a position adjacent the most intense field past each successively weaker field of opposite polarity will expose the marker affixed thereto to fields of alternate polarities and exponentially decreasing intensities to substantially demagnetize the control element of the marker using only the necessary number of field reversals.

BRIEF DESCRIPTION OF THE DRAWINGS

The various objects, features, and advantages of the present deactivating device will be understood upon reading and understanding the following detailed description and accompanying drawings, in which.

DETAILED DESCRIPTION OF THE INVENTION

Figure 1A:
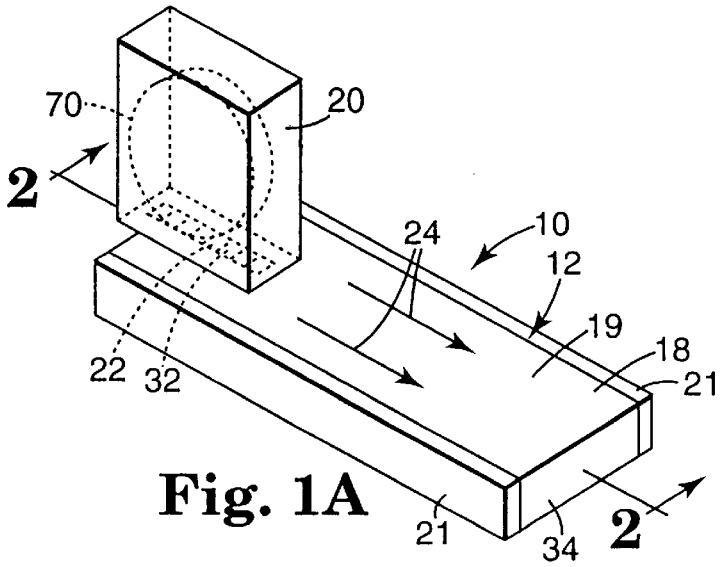
FIG. 1A is a perspective view of one embodiment of the demagnetization apparatus of the present invention.
Figure 1B:
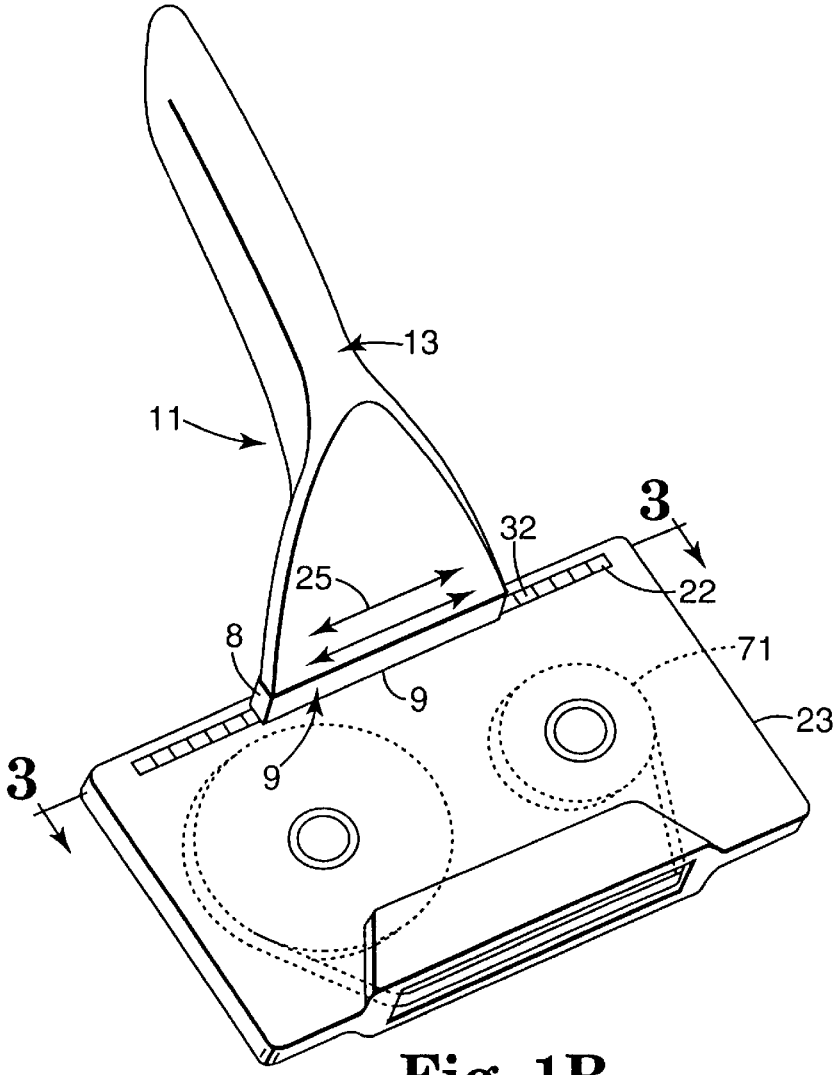
FIG. 1B is a perspective view of an alternative embodiment of the demagnetization apparatus of the present invention.
Figure 2A:
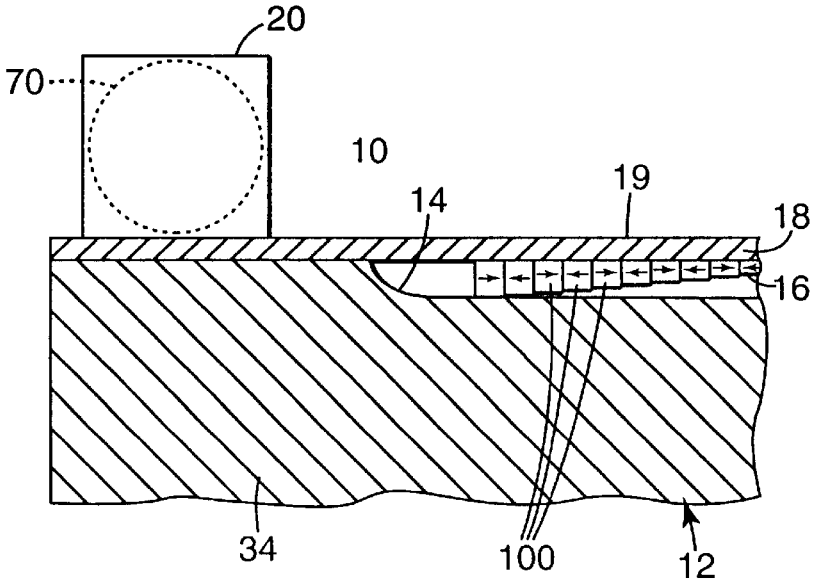
FIG. 2A is an enlarged cross sectional view of FIG. 1A, taken along the lines 2—2.

As shown in FIG. 1, the demagnetization apparatus of the present invention may be in the form of a counter top apparatus 10 as in FIG. 1A or a hand held apparatus 11 as in FIG. 1B. The apparatus could also take other forms as will be recognized by those of skill in the art. The counter top apparatus 10 is shown in FIGS. 1A and 2A as having a housing 12, and contained within a cavity 14 (shown in FIG. 2A) therein an elongated magnetic section 16 (shown in FIG. 2A) as described hereinafter. The cavity 14 is in turn covered by a non-magnetic cover plate 18 which both covers and protects the elongated magnetic section 16. In addition, the cover plate 18 provides a working surface 19 relative to which an article 20 having a marker 22 affixed thereto may be moved during the use of the apparatus. For example, such a cover plate 18 may comprise a strip of non-magnetic stainless steel having a thickness in the range of 20 mils (0.50 mm). The use of a metallic cover plate 18 is further desired as such a surface resists wear from scratching or chipping as may otherwise occur with cover plates having a polymeric or painted surface, and it thereby remains aesthetically acceptable even over many cycles of use.

Figure 2B:
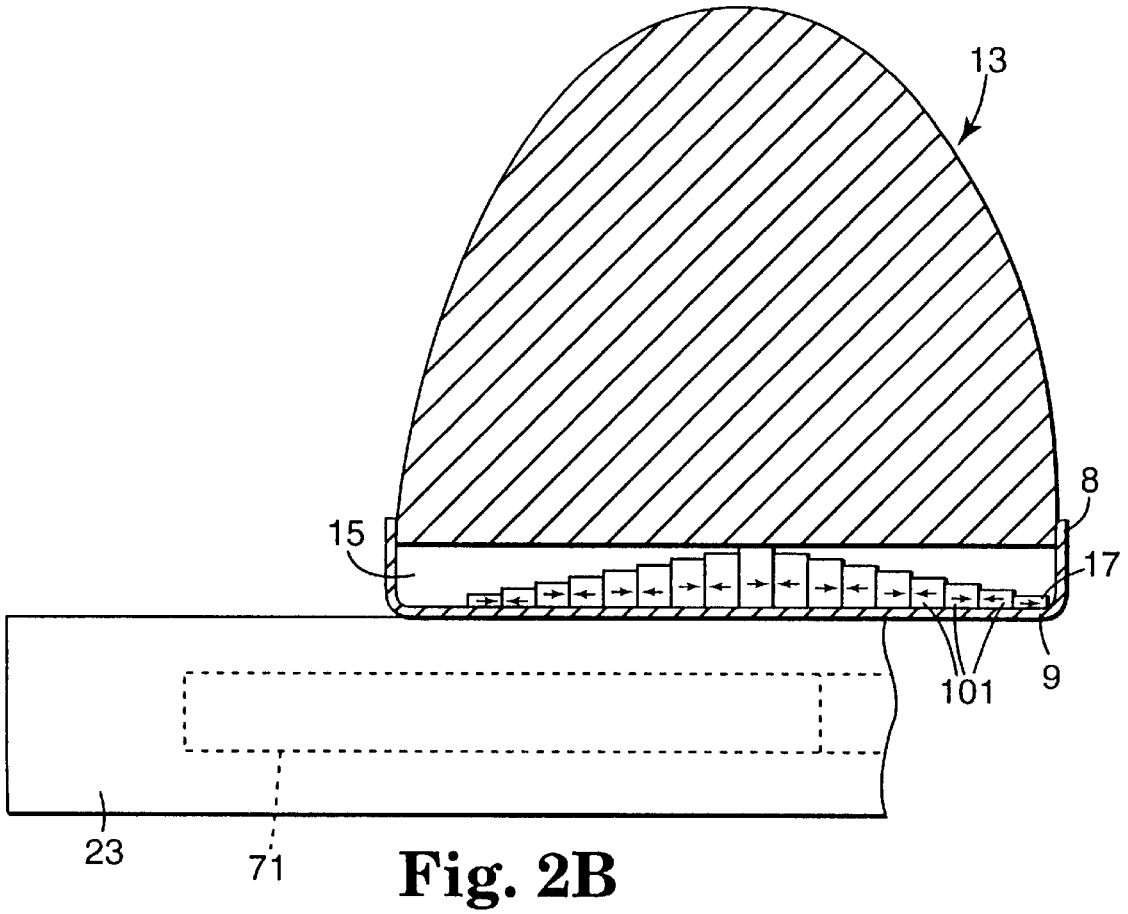
FIG. 2B is an enlarged cross sectional view of FIG. 1B, taken along the lines 3—3.

The hand held apparatus 11 is shown in FIGS. 1B and 2B as having a contoured housing 13 suitable for easy gripping and manipulation by a human hand, and contained within a cavity 15 (shown in FIG. 2B) therein an elongated magnetic section 17 (shown in FIG. 2B) as described hereinafter. The cavity 15 is in turn defined by the space between the housing and a non-magnetic cap 8 separate from the housing that is either permanently or temporarily affixed thereto. In addition, the cap 8 provides a working surface 9 relative to which an article 23 having a marker 22 affixed thereto may be moved during the use of the apparatus. For example, such a cap 8 may comprise a suitably shaped or machined piece of non-magnetic stainless steel having a thickness in the range of 20 mils (0.50 mm). The use of a metallic cap 8 is further desired as such a surface resists wear from scratching or chipping as may otherwise occur with caps having a polymeric or painted surface, and it thereby remains aesthetically acceptable even over many cycles of use.

While the apparatus 10 may be used with the working surface 19 established by the cover plate 18 in a horizontal position, such that an article 20 may be moved across the horizontal surface, the apparatus may also be positioned to have the working surface 19 vertical. Similarly, while the apparatus 11 may be used with the working surface 9 established by the cap 8 in a horizontal position, such that the apparatus 11 may be moved across the horizontal surface of an article 23, the apparatus may also be positioned to have the working surface 9 oriented toward any direction.

The housing 12 of the apparatus 10, as shown in FIG. 1A, includes two sides 21. The housing is preferably constructed of non-magnetic materials, and may be fabricated from appropriately dimensioned and finished hardwood, or may be formed from injection molded or machined plastic. Also, beveled faces (not shown) may be provided on the housing 12 to carry appropriate legends, manufacturer identification, instructions, and the like.

In using the apparatus of FIG. 1A, it will be recognized that the article 20 is to be moved in the direction shown by arrows 24, thus causing the marker 22 affixed to one surface of the article to be moved so that the marker 22 is passed over the elongated magnetic section 16 contained within the cavity 14. Thus, for example, if the article 20 is a typically packaged video cassette, the marker 22 could be affixed to one side of the cassette, and the cassette held so as to be positioned on the cover plate 18 and passed along the working surface 19 in the direction of the arrows 24. The demagnetization of the control element 32 is effected upon exposure to the fields provided by the elongated magnetic section 16 when the element 32 is brought into close proximity with the magnetic fields associated with the section 16 at the working surface 19.

The housing 13 of the apparatus 11, as shown in FIG. 1B, may be formed into any desirable shape suitable for hand held use and is not limited to the particular design illustrated in FIG. 1B. The housing is preferably constructed of non-magnetic materials, and may be fabricated from appropriately dimensioned and finished hardwood, or may be formed from injection molded or machined plastic.

In using the apparatus of FIG. 1B, it will be recognized that the apparatus 11 is to be moved along the marker 22 affixed to one surface of the article 23 in either direction indicated by the arrows 25, thus passing the elongated magnetic section 17 contained within the cavity 15 over the marker such that the working surface 9 remains in close proximity or in actual contact with the marker. Thus, for example, if the article 23 is one of several typically packaged audio cassettes each affixed with a marker 22 and each positioned in a fold-up container designed to hold multiple audio cassettes, the apparatus 11 could be held so that it may be passed in the direction of the arrows 25 over each marker of each audio cassette in succession without removing the audio cassettes from the container. The demagnetization of the control element 32 is affected upon exposure to the fields provided by the elongated magnetic section 17 when the element 32 is brought into close proximity with the magnetic fields associated with the section 17 at the working surface 9.

The marker 22 is typically constructed of a strip of a high permeability, low coercive force magnetic material such as a permalloy, certain amorphous alloys, or the like as disclosed, for example, in U.S. Pat. No. 3,790,945 (Fearon). The marker is further provided with at least one control element 32 of high coercive force magnetizable material as disclosed, for example, in U.S. Pat. No. 3,747,086 (Peterson). The control element 32 is typically formed of a material such as vicalloy, magnetic stainless steel or the like, having a predetermined value of coercive force in the range of 50 to 240 oersteds. When such an element is magnetized, it prevents the marker from being detected by the system when the marker 22 is present in the interrogation zone. Further examples of dual status markers for use with electromagnetic article surveillance systems are disclosed in U.S. Pat. No. 5,432,499 (Montean), U.S. Pat. No. 5,331,313 (Koning), U.S. Pat. No. 5,083,112 (Piotrowski), U.S. Pat. No. 4,967,185 (Montean), U.S. Pat. No. 4,884,063 (Church), U.S. Pat. No. 4,825,197 (Church), U.S. Pat. No. 4,745,401 (Montean), and U.S. Pat. No. 4,710,754 (Montean).

The details of the elongated magnetic section 16 of the device shown in FIG. 1A are shown in the cross sectional view of FIG. 2A. As may there be seen, the housing 12 of the apparatus 10 is shown to have a cavity 14 within which the elongated magnetic section 16 may be positioned and supported by the cover plate 18 within the cavity enclosed by the cover plate 18. As an alternative, the section may be held in position within the cavity 14 by the housing, or by a frame 34 (not shown). As shown, the elongated magnetic section 16 has a plurality of poles 100 in a succession of closely spaced fields of alternate polarity and of suitable intensity so as to create at the working surface 19 a magnetic field of alternating polarity and an intensity that decreases within an exponential envelope from one end of the elongated magnetic section 16 to the other. The total number of field reversals provided by poles 100 is preferably less than 50, more preferably less than 40, more preferably less than 30, more preferably less than 20 and even more preferably less than 10. Each pole 100 preferably extends across the width of the section 16, and the succession of poles extends along the length of the section 16. The poles 100 are shown in FIG. 2A as abutting rectangles of generally decreasing size, representing poles of decreasing strength, each of which is preferably positioned so that the surface closest to the cover plate 18 fully contacts the cover plate. Although the poles 100 are shown as generally decreasing in size, this is representational of decreasing strength only and not necessarily of actual physical size. The important factor regarding the strength of the poles is that the strength of each pole 100 is preferably determined so that the fields created at the working surface 19 decrease within an exponential envelope along the length of the magnetic section 16.

The details of the elongated magnetic section 17 of the device shown in FIG. 1B are shown in the cross sectional view of FIG. 2B. As may there be seen, the housing 13 of the hand held apparatus 11 is shown to have a cavity 15 within which the elongated magnetic section 17 may be positioned and supported by the housing, or by the cap 8, or both. As shown, the elongated magnetic section 17 has a plurality of poles 101 in a succession of closely spaced fields of alternate polarity and of suitable intensity so as to create at the working surface 9 magnetic fields of alternating polarity that decrease in intensity within an exponential envelope from the center of the elongated magnetic section 17 to each end. The total number of field reversals provided by poles 101 is preferably less than 50, more preferably less than 40, more preferably less than 30, more preferably less than 20, and even more preferably less than 10 on each half ofthe magnetic section 17. The decrease in field intensity at the working surface from the center of the magnetic section 17 to each end is preferably symmetric about the center of the magnetic section. Each pole is positioned so that the surface closest to the cap 8 preferably contacts the cap. Each pole 101 preferably extends across the width of the section 17, and the succession of poles extends along the length of the section 17. The poles 101 are shown in FIG. 2B as abutting rectangles, the largest of which is positioned in the center of the magnetic section 17, and the remainder having generally decreasing field strength with increasing distance from the center. Although the poles 101 are shown as generally decreasing in size away from the center, this is representational of decreasing field strength only and not necessarily of actual physical size. The important factor regarding the strength of the poles is that the field strength of each pole 101 is determined so that the field created at the working surface 9 reaches peak intensity at about the center of the elongated magnetic section 17 and decreases in strength within an exponential envelope, and preferably symmetrically, from about the center to the ends of the magnetic section.

Although the exponentially decreasing alternating magnetic fields produced by magnetic section 16 and magnetic section 17 in the preferred embodiments of the present invention are produced by varying the strength of each pole 100, one of ordinary skill in the art will appreciate that such fields may be created at the working surface by other methods which include providing appropriate shielding to alter the effective strength of each pole and adjusting the position of each pole relative to both the working surface and to other poles.

For the counter top apparatus 10, the field produced at the working surface decreases within an exponential envelope in the direction of the arrows 24. For the hand held apparatus 11, the field produced at the working surface is at a maximum at the center of the elongated section 17 and decreases in intensity within an exponential envelope in each direction of the arrows 25 with increased distance along the elongated section from the center of the elongated section. In such a configuration, the apparatus 11 may be passed over a marker 22 in either direction indicated by the arrows 25, and the marker will experience an exponentially decreasing alternating magnetic field once the region of maximum field intensity passes over the marker.

The elongated magnetic sections 16 and 17 may be made of any suitable magnetic materials including, but not limited to, any combination of the following: (1) an injection molded permanent magnet material, such as type B-1060 "Plastiform" Brand sold by Arnold Company of Norfolk, Nebr., which is subsequently magnetized after molding and arranged with alternating poles; (2) a sheet material magnetized with alternating poles, such as type B-1013 "Plastiform" Brand, type 2002-B "Plastiform" Brand, or type 1030-B "Plastiform" Brand, all sold by Arnold Company of Norfolk Nebr.; or (3) a machineable metallic material such as Nd 35 or Nd 40 or other NdFeB (neodymium, iron, and boron) alloy such as sold under the brand name Magnaquench by MagStar Technologies, St. Anthony, Minn. Other appropriate materials will also be recognized by those of skill in the art.

Figure 3:
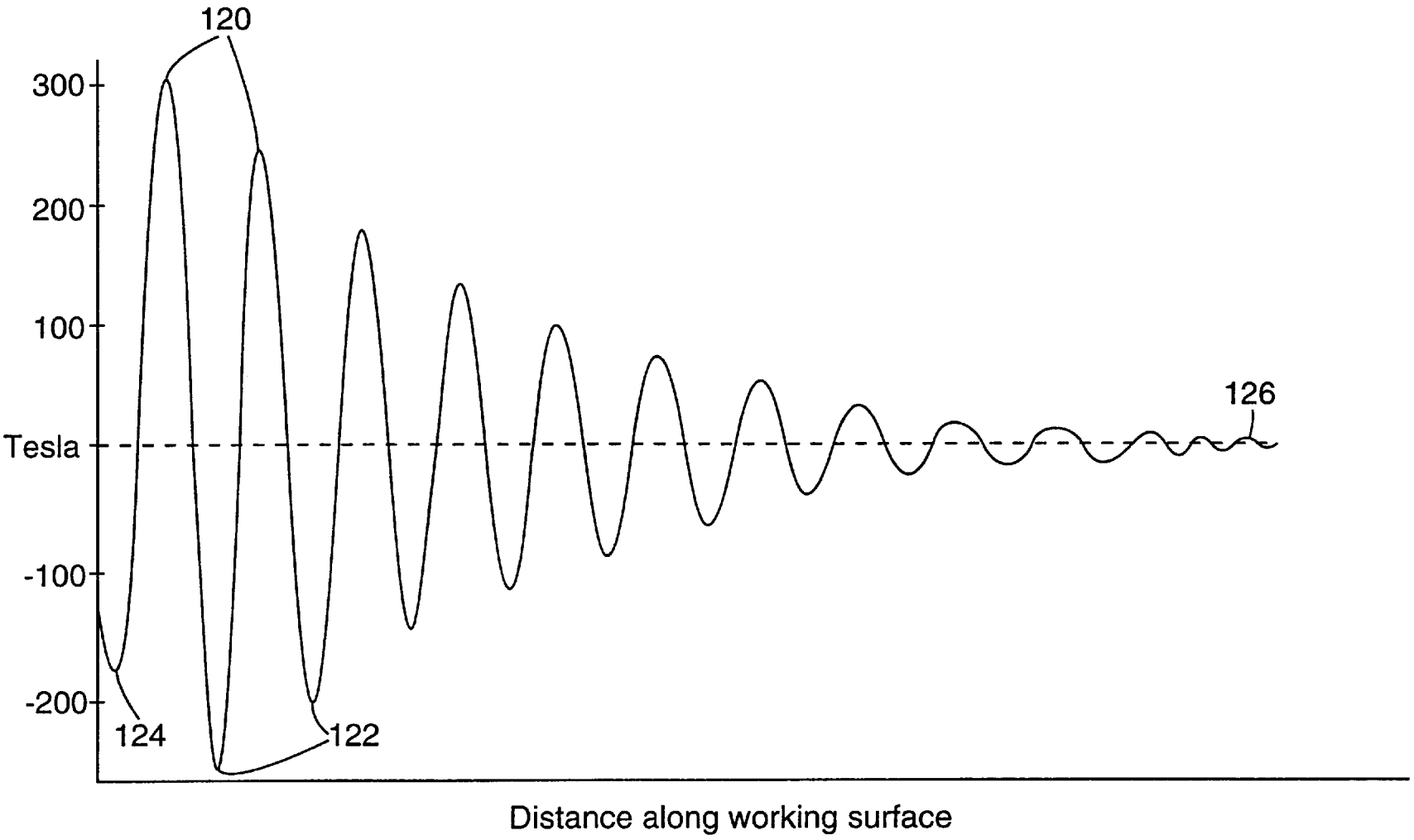
FIG. 3 is a graph representing the field strength and polarity along the working surface for a specific embodiment.

The alternating magnetic field of exponentially decreasing intensity produced by the magnetic section 16 at the working surface 19 or by one half of the magnetic section 17 at the working surface 9 is illustrated in FIG. 3. Each successive peak 120 and valley 122 represents the field at the working surface directly above the corresponding pole of the magnetic section. The percent decrease in pole strength between any two successive poles determines how many field reversals are required to achieve demagnetization of the control elements, and thus how long the magnetic section 16 or 17 must be. If the fields were to decrease too slowly, the elongated magnetic section would need to be impractically long, and if the fields were to decrease too rapidly, the demagnetization of the control element would not be complete. It has been found that demagnetization will occur if on the average the field intensity at the working surface associated with each successive pole changes by 5 to 20 percent between any two adjacent poles. Preferably, the field intensity at the working surface associated with each successive pole changes by approximately 15 percent between any two adjacent poles.

The magnetic field intensity and polarity at a given position P at the working surface is governed by the algebraic sum of the intensity and polarity of each pole reduced appropriately according to its distance from the position P. Thus, the field contribution of any given pole is affected by the field contribution of its adjacent poles, its next nearest poles, and so on. The poles positioned at each end of the elongated magnetic section 16 or 17, however, are adjacent to only one other pole and thus may have an undesirably large contribution to the magnetic field at the working surface in the region above these end poles. For this reason, the end poles must be carefully selected and adjusted so that their contribution to the field intensity at the working surface is not so large so as to deviate from the exponential envelope of the entire magnetic circuit. It will be appreciated by one of skill in the art that the selection and adjustment of the end poles may be properly affected by partial shielding of the end magnets, adjusting the spacing of the end magnets relative to the working surface and to the other magnets, adjusting the magnet strength by material or size of the magnet, by adequately trimming the end magnets, or by offsetting the end magnets relative to the working surface.

It is preferred that the most intense peak or valley seen by the control element is strong enough to initiate the demagnetization process by ensuring that all magnetic domains in the control element are oriented in one direction parallel with the initial field. Subsequent to the most intense pole, each field reversal ends preferably in a peak or valley whose intensity is decreased by approximately the same percentage from the previous peak or valley. It is also preferred that the last peak or valley seen by the control element is weaker than all previous poles so that the control element is not left with an undesirable net magnetization. Thus, as illustrated by the final peak 126 shown in FIG. 3, the final pole is preferably chosen so that the field falls off to zero in concert with the exponential envelope.

In order to initiate the demagnetization process, it has been found that the most intense pole is preferably at least approximately one and one half times the predetermined value of coercive force of the control elements. However, it is also preferred that the field intensity is not strong enough to adversely affect a magnetically sensitive object 70 contained within the article 20 during demagnetization of the control elements. Prerecorded audio cassettes are adversely affected by magnetic fields greater than about 100 oersteds while prerecorded video cassettes can withstand higher fields, perhaps as much as 300 oersteds. It is necessary that the fields of the demagnetization apparatus decrease rapidly away from the working surface 19 so as to be sufficiently small at a distance D measured from the working surface 19 to the magnetically sensitive object 70 (see FIG. 1). A typical distance D is within the range of 1/16 to 1/8 of an inch. This is accomplished by keeping the pole spacing small enough so that away from the surface, different poles contribute to the effective field, resulting in partial cancellation from adjacent poles of opposite polarity. At the same time, the pole spacing must not be too small or the fields at the surface will not be intense enough to start the demagnetization process. Thus, to demagnetize the control element 32 of the affixed marker 22 without adversely affecting a prerecorded cassette, a field intensity of no more than 450 oersteds, preferably in the range of 350–420 oersteds at approximately 0.030 inch above the working surface with a pole spacing of 6 or 7 poles per inch.

When an alternating magnetic field decreases within an exponential envelope, the percent decrease between any two adjacent poles remains constant. The rapidity with which the field decreases in such a magnetic circuit may be described as its Q value, defined by:

$$Q=-n\pi/\ln(H_o/H_n)$$

wherein $H_o$=field at the working surface associated with any given pole; and $H_n$=field at the working surface associated with a pole located n poles away from the given pole. A magnetic section with an exponentially decreasing field along the working surface is thus defined by a constant Q value. An alternating field that decreased approximately 15 percent between adjacent poles would thus have a Q value of approximately 9.5.

A series of poles establishing a magnetic field with a constant Q value ensures that a control element moved relative to the magnetic field in the direction of decreasing field strength will be incrementally demagnetized, undergoing a net demagnetization by the same percent with each field reversal. A magnetic field that does not decrease exponentially will necessarily have regions where the incremental demagnetization occurs too rapidly, too slowly, or both, resulting in the control element not being completely demagnetized or an apparatus that is larger than necessary to achieve full demagnetization.

In contrast to the demagnetization apparatus of the present invention, the Heltemes apparatus disclosed in U.S. Pat. No. 4,689,590 and U.S. Pat. No. 4,752,758 utilized a plurality of closely spaced poles alternating in polarity but of generally equal intensity. The decrease in field intensity at the working surface of the Heltemes apparatus was achieved by mounting the magnetic section at an incline relative to the working surface so that the distance between the working surface and the magnetic section increases, and by arranging the poles such that the lines drawn from the north pole to the south pole for each discrete piece lies perpendicular to the length of the magnetic section. The decrease in field intensity at the working surface for the Heltemes apparatus is typically non-uniform due to small variations in size and magnetization of different poles. In addition, because the magnetic section slopes linearly away from the working surface along the length of the working surface, the magnetic field at the working surface is proportional to the inverse of the distance along the working surface, and thus does not decrease at a constant percentage with each field reversal.

Figure 4:
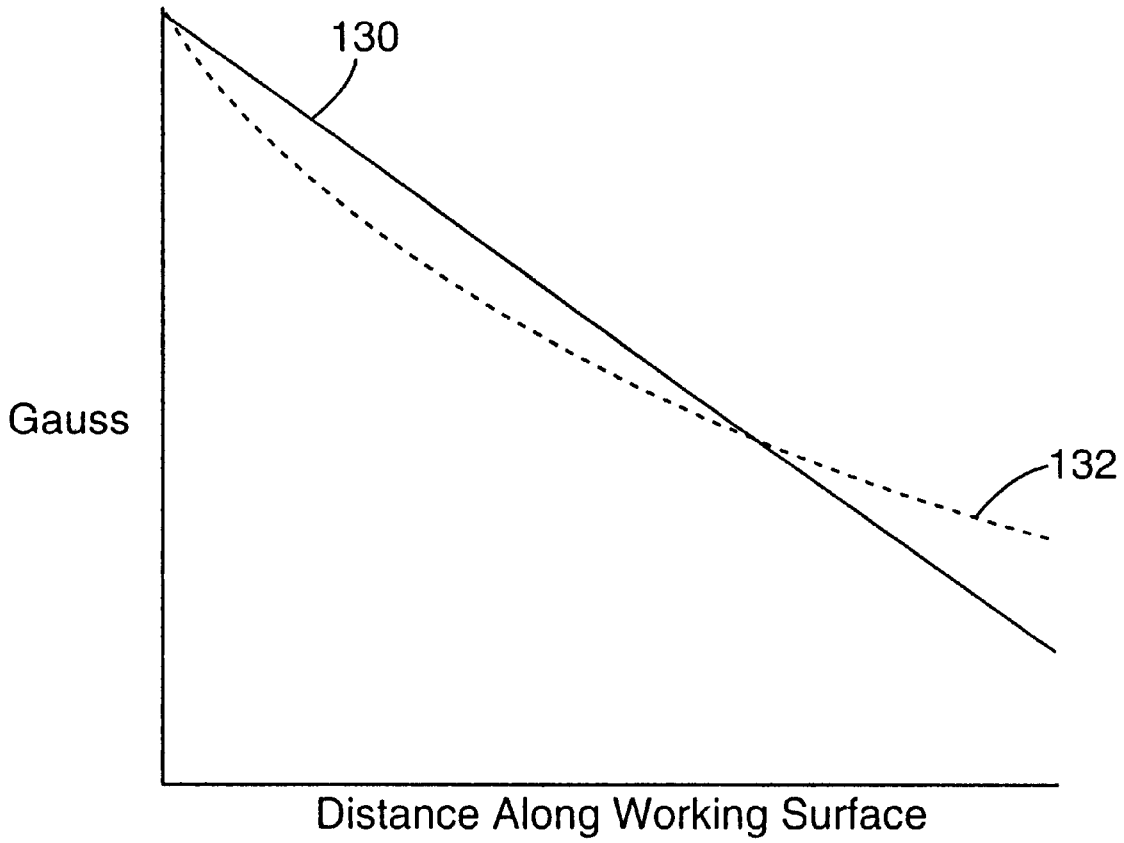
FIG. 4 is a stylized graph illustrating field strength along the working surface for the demagnetization apparatus of the present invention compared to a prior art demagnetization apparatus.

FIG. 4 schematically illustrates the decrease in peak to peak field intensity with distance along the working surface for the demagnetization apparatus of the present invention 130 and for the Heltemes apparatus 132. FIG. 4 thus represents a semi-log plot of the envelope in which the alternating fields decrease in both the apparatus of the present invention 130 and the Heltemes apparatus 132. As can there be seen, an exponentially decreasing alternating magnetic field such as embodied in the present invention yields a straight line 130 on a semi-log plot, thus denoting a constant Q value and a constant percent decrease. In contrast, the behavior of the Heltemes apparatus, represented by the line 132, deviates from the behavior of the demagnetization apparatus of the present invention, represented by the line 130, in that the magnetic field of the Heltemes apparatus decreases in some regions faster than in other regions. When a demagnetization apparatus such as the Heltemes apparatus comprises a magnetic field that deviates from constant percentage decrease, there will be regions in which the magnetic field decreases too rapidly, thus risking a residual magnetization of the control element, and there will be regions in which the magnetic field decreases too slowly, thus requiring a longer magnetic section than would be required for an alternating field that decreases by a constant percentage with each field reversal.

Figure 5:
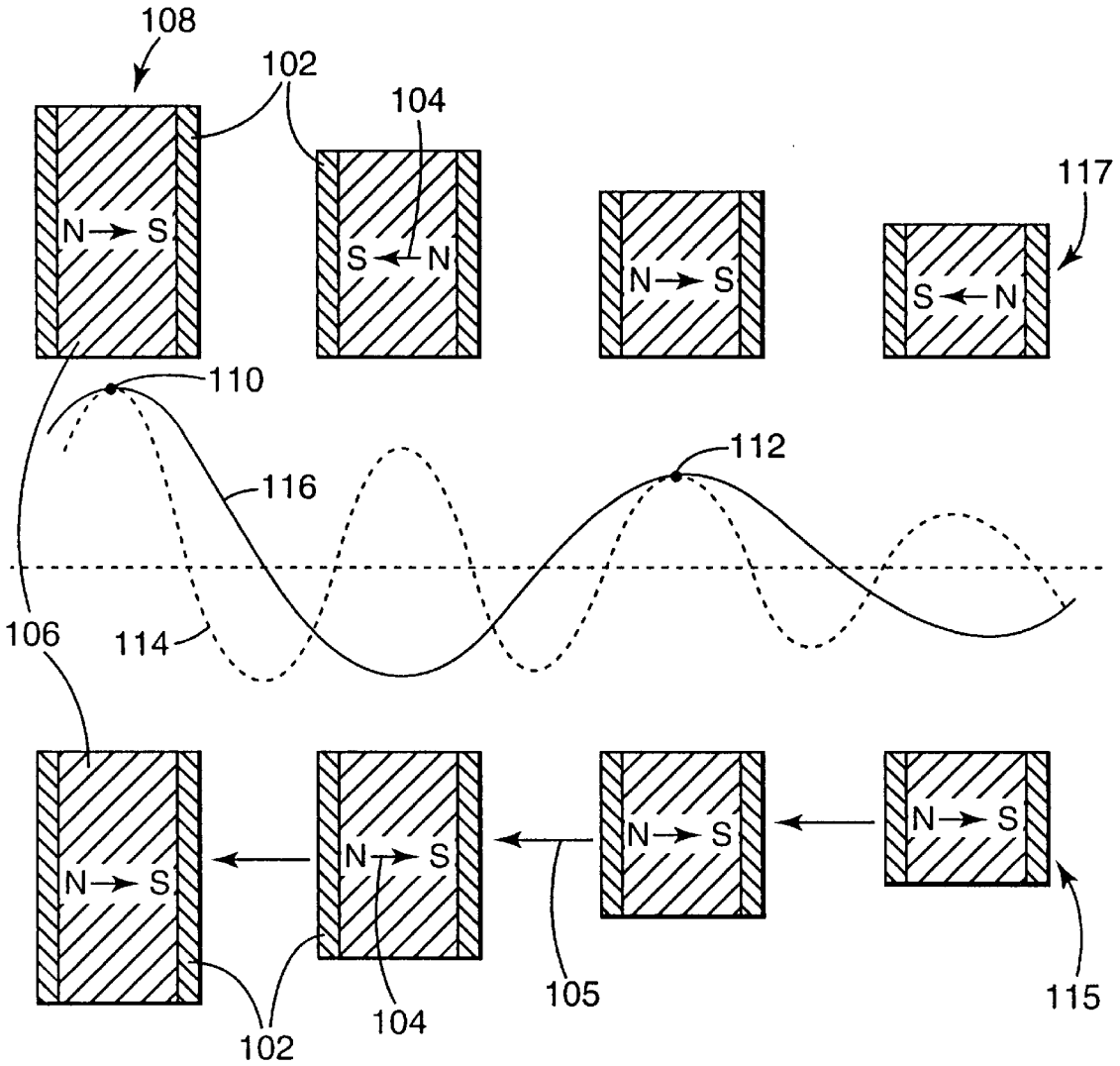
FIG. 5 is a schematic representation of an enlarged section of two preferred embodiments of the elongated magnetic section of FIGS. 2A and 2B and the alternating magnetic field produced by each.

The preferred embodiment of elongated magnetic section 16 is a calibrated array of discrete pieces each comprising a length of permanently magnetized material sandwiched between two flux collectors. The magnetic polarity of each discrete piece alternates from piece to piece so that the line drawn from the north pole to the south pole for each discrete piece lies along the length of the magnetic section (see, e.g. FIGS. 2A and 2B). The array is preferably calibrated by choosing the magnet material for each discrete piece and adjusting the size of the magnet so that when it is positioned in its proper place in the array the magnetic section will display an alternating field of exponentially decreasing intensities. FIG. 5 schematically illustrates the preferred construction of each discrete piece 108 from a cross sectional view. Each piece 108 is constructed from a length of permanently magnetized material 106 and positioned so that its magnetic pole is aligned along the length of the array as indicated by arrow 104. The size of each permanent magnet 106 and the material from which it is made is chosen so that the magnetic field produced at the working surface 19 for the entire array alternates and decreases at a constant percentage with each field reversal. The flux collectors 102 that sandwich each permanent magnet 106 gather the flux lines produced by the permanent magnet so that the field at the working surface above each pole is parallel to the working surface. These flux collectors 102 are preferably made from a mild steel. While the detailed magnetic properties of the flux collectors 102 is not critical, the flux collectors 102 should preferably be designed to absorb at least as much of the magnetic flux produced by its associated permanent magnet.

The discrete pieces 108 of the magnetic section are preferably arranged in one of two ways in order to generate a series of alternating poles, as illustrated in FIG. 5. The upper series of magnets 117 shows a section of an array in which each magnet 106 has a polarity 104 that is counter parallel (parallel and in the opposite direction) to the polarities of its adjacent magnets. Such an arrangement produces an alternating magnetic field 116 that successively reaches a maximum positive intensity and a maximum negative intensity directly above the center of each magnet 106 and reaches zero intensity above the midpoint between two adjacent magnets as shown by waveform 116. In such an arrangement, the number of discrete pieces 108 equals the total number of field maxima and minima. The lower series of magnets 115 shows a section of an array in which each magnet 106 has a polarity 104 that is parallel and in the same direction to the polarity of its adjacent magnet. Such an arrangement produces flux lines running from north to south for each individual magnet 106, but it also creates induced poles 105 that produce flux lines running in the opposite direction between magnets from the north of one magnet to the south of the adjacent magnet. In such a manner, an alternating magnetic field 114 is produced that successively reaches a maximum positive intensity directly above each magnet, and a maximum negative intensity above the midpoint between adjacent magnets. In this arrangement, there are twice as many total maxima and minima as there are discrete pieces 108 in the array.

The two arrays 117 and 115 both create alternating magnetic fields, but with different periodicities. FIG. 5 illustrates that between the points 110 and 112 the field produced by array 117 has two field reversals whereas the field produced by the array 115 has four field reversals and each array uses the same number of magnets 106. Thus, half as many magnets are required when using the principle behind array 115 to design an elongated magnetic section to achieve the same number of field reversals as with array 117. This is important when the size of the array is a critical issue as with the hand held apparatus shown in FIG. 1B. By fabricating an elongated magnetic section using a magnet array such as array 115, a much shorter magnetic section will be attained so that a housing with much smaller dimensions can be used.

In addition to having the advantages of more reliable demagnetization performance and smaller size of the magnet array, the performance of the demagnetization apparatus of the present invention is not speed dependent. The demagnetization of the control element does not depend on the speed with which the control element is moved relative to the elongated magnetic section because the control element will experience an alternating magnetic field that decreases by a constant percentage with each field reversal without regard to the rate of movement. Thus, the only limitation on the speed with which the control element may be moved relative to the elongated magnetic section is determined by the response rate of the magnetic domains of the control element material. However, typical rates of movement during human usage of the demagnetization apparatus of the present invention are in the range of 400 to 700 Hz, which is well below the rate limitation due to magnetic domain response times to magnetic fields.

One exemplary preferred embodiment configuration of elongated magnetic section 16 with respect to material, length, width, thickness, and orientation of each permanent magnet 106, the width of the flux collectors 102, and the total number of discrete pieces 108 is tabulated in Table 1. The magnet orientation data in Table 1 are represented by arrows which indicate the north to south orientation of each magnet.

TABLE 1

| magnet # | magnet material | magnet orientat'n | magnet length | magnet width | magnet thickness | flux collector |
|---|---|---|---|---|---|---|
| 1 | Nd 35 | → | 4.0 | 0.108 | 0.5 | 0.060 |
| 2 | Nd 35 | ← | 4.0 | 0.187 | 0.5 | 0.060 |
| 3 | Nd 35 | → | 4.0 | 0.165 | 0.5 | 0.060 |
| 4 | Nd 35 | ← | 4.0 | 0.140 | 0.5 | 0.060 |
| 5 | Nd 35 | → | 4.0 | 0.159 | 0.331 | 0.060 |
| 6 | Nd 35 | ← | 4.0 | 0.125 | 0.372 | 0.060 |
| 7 | 2002B Arnold Plastiform | → | 4.0 | 0.229 | 0.5 | 0.060 |
| 8 | 2002B Arnold Plastiform | ← | 4.0 | 0.203 | 0.5 | 0.060 |
| 9 | 2002B Arnold Plastiform | → | 4.0 | 0.171 | 0.5 | 0.060 |
| 10 | 2002B Arnold Plastiform | ← | 4.0 | 0.146 | 0.5 | 0.060 |
| 11 | 2002B Arnold Plastiform | → | 4.0 | 0.129 | 0.5 | 0.060 |
| 12 | 2002B Arnold Plastiform | ← | 4.0 | 0.125 | 0.372 | 0.060 |
| 13 | 2002B Arnold Plastiform | → | 4.0 | 0.125 | 0.290 | 0.060 |
| 14 | 2002B Arnold Plastiform | ← | 4.0 | 0.125 | 0.234 | 0.048 |
| 15 | 2002B Arnold Plastiform | → | 4.0 | 0.125 | 0.183 | 0.048 |
| 16 | 2002B Arnold Plastiform | ← | 4.0 | 0.125 | 0.144 | 0.048 |
| 17 | 2002B Arnold Plastiform | → | 4.0 | 0.125 | 0.122 | 0.048 |
| 18 | B1030 Arnold Plastiform | ← | 4.0 | 0.125 | 0.311 | 0.048 |
| 19 | B1030 Arnold Plastiform | → | 4.0 | 0.125 | 0.265 | 0.048 |
| 20 | B1030 Arnold Plastiform | ← | 4.0 | 0.132 | 0.184 | 0.048 |
| 21 | B1030 Arnold Plastiform | → | 4.0 | 0.090 | 0.235 | 0.048 |
| 22 | B1030 Arnold Plastiform | ← | 4.0 | 0.090 | 0.158 | 0.048 |
| 23 | B1030 Arnold Plastiform | → | 4.0 | 0.090 | 0.122 | 0.048 |
| 24 | B1030 Arnold Plastiform | ← | 4.0 | 0.090 | 0.102 | 0.048 |
| 25 | B1030 Arnold Plastiform | → | 4.0 | 0.060 | 0.125 | 0.048 |
| 26 | B1030 Arnold Plastiform | ← | 4.0 | 0.060 | 0.98 | 0.048 |
| 27 | B1030 Arnold Plastiform | → | 4.0 | 0.060 | 0.75 | 0.048 |
| 28 | B1030 Arnold Plastiform | ← | 4.0 | 0.030 | 0.179 | 0.048 |
| 29 | B1030 Arnold Plastiform | → | 4.0 | 0.030 | 0.122 | 0.048 |
| 30 | B1030 Arnold Plastiform | ← | 4.0 | 0.030 | 0.094 | 0.048 |

We claim:

1. An apparatus which in movement relative to an article, having affixed thereto a dual status anti-theft marker including at least one control element, demagnetizes the control element to change the status of the marker, the apparatus comprising:

(a) a housing having a working surface; and (b) an elongated section of permanent magnetic material that exhibits an alternating magnetic field having, after a most intense peak, a substantially constant percentage decrease within an exponential envelope with each field reversal along the working surface.

2. The apparatus according to claim 1, wherein the substantially constant percentage decrease is in the range of 5 to 20 percent.

3. The apparatus according to claim 1, wherein the substantially constant percentage decrease is about 15 percent.

4. The apparatus according to claim 1, wherein the elongated section comprises an array of discrete pieces of permanent magnetic material, and wherein the discrete pieces are calibrated to produce the alternating magnetic field having the substantially constant percentage decrease.

5. The apparatus according to claim 4 wherein the discrete pieces of permanent magnet material are aligned such that a line drawn from each pieces north pole to each pieces south pole lies parallel to the working surface.

6. The apparatus according to claim 5, wherein the array includes less than 50 discrete pieces of permanent magnetic material.

7. The apparatus according to claim 5, wherein the array includes less than 30 discrete pieces of permanent magnetic material.

8. The apparatus according to claim 5, wherein the array includes less than 20 discrete pieces of permanent magnetic material.

9. The apparatus according to claim 5, wherein the array includes less than 10 discrete pieces of permanent magnetic material.

10. The apparatus according to claim 5, wherein at least one of said discrete pieces of permanent magnetic material comprises an injection molded permanent magnet material.

11. The apparatus according to claim 5, wherein at least one of said discrete pieces of permanent magnetic material comprises an alloy of neodymium, iron, and boron.

12. The apparatus according to claim 5, further comprising at least one flux collector, positioned with respect to an associated discrete piece of permanent magnetic material such that flux lines produced by the associated discrete piece of magnetic material are parallel with the working surface at the working surface.

13. The apparatus according to claim 9, wherein at least one of said flux collectors comprises a mild steel.

14. The apparatus according to claim 9, wherein at least one of said flux collectors is affixed the associated discrete piece of permanent magnetic material.

15. The apparatus according to claim 1, wherein the elongated section exhibits an alternating magnetic field having a substantially constant percentage increase with each field reversal along the working surface until a field of maximum intensity is attained, further having, after the field of maximum intensity, a substantially constant percentage decrease with each field reversal along the working surface.

16. The apparatus according to claim 15, wherein the field of maximum intensity is approximately one and one-half times a coercive force of the control element.

17. The apparatus according to claim 15, wherein the elongated section comprises an array of discrete pieces of permanent magnetic material, and wherein the discrete pieces are calibrated to produce the alternating magnetic field.

18. The apparatus according to claim 17, wherein at least one of said discrete pieces of permanent magnetic material comprises an injection molded permanent magnet material.

19. The apparatus according to claim 17, wherein at least one of said discrete pieces of permanent magnetic material comprises an alloy of neodymium, iron, and boron.

20. The apparatus according to claim 17, further comprising at least one flux collector positioned with respect to an associated discrete piece of permanent magnetic material such that flux lines produced by the associated discrete piece of magnetic material are parallel with the working surface at the working surface.

21. The apparatus according to claim 20, wherein at least one of said flux collectors comprises a mild steel.

22. The apparatus according to claim 20, wherein at least one of said flux collectors is affixed to the associated discrete piece of permanent magnetic material.

23. The apparatus according to claim 1, wherein the alternating magnetic field has less than 50 field reversals.

24. The apparatus according to claim 23, wherein the alternating magnetic field has less than 40 field reversals.

25. The apparatus according to claim 23, wherein the alternating magnetic field has less than 30 field reversals.

26. The apparatus according to claim 23, wherein the alternating magnetic field has less than 20 field reversals.

27. The apparatus according to claim 23, wherein the alternating magnetic field has less than 10 field reversals.

28. An array of permanently magnetized regions establishing an alternating magnetic field along the length of the array for use in an apparatus for demagnetizing a magnetic marker, the array comprising at least three permanently magnetized regions established by one or more discrete pieces of permanent magnetic material, each region having a net polarization vector wherein major component of the net polarization vector for demagnetizing is parallel to the plane of the array.

29. An array of permanently magnetized regions according to claim 28, wherein at least one of said discrete pieces of permanent magnetic material has a polarization vector component that is counter parallel to a polarization vector component of an adjacent discrete piece of permanent magnetic material.

30. An array of permanently magnetized regions according to claim 28, wherein at least one of said discrete pieces of magnetic material has a polarization vector component parallel to a polarization vector component of an adjacent discrete piece of permanent magnetic material.

31. An array of permanently magnetized regions according to claim 28, wherein each region comprises one discrete piece of permanent magnetic material.

32. An array of permanently magnetized regions according to claim 31, wherein at least one of said discrete pieces of permanent magnetic material comprises an injection molded permanent magnet material.

33. An array of permanently magnetized regions according to claim 31, wherein at least one of said discrete pieces of permanent magnetic material comprises an alloy of neodymium, iron, and boron.

34. An array of permanently magnetized regions according to claim 31, further comprising at least one flux collector positioned with respect to an associated discrete piece of permanent magnetic material such that flux lines produced by the associated discrete piece of magnetic material are parallel with the plane of the array at a predetermined distance from the array.

35. An array of permanently magnetized regions according to claim 34, wherein at least one of said flux collectors comprises a mild steel.

36. An array of permanently magnetized regions according to claim 34, wherein at least one of said flux collectors is affixed to the associated discrete piece of permanent magnetic material.

37. An array of permanently magnetized regions according to claim 28, wherein at least a portion of the alternating magnetic field produced by the array decreases in a substantially exponential envelope.

* * * * *

UNITED STATES PATENT AND TRADEMARK OFFICE

CERTIFICATE OF CORRECTION

PATENT NO. : 6,002,335 
DATED : December 14, 1999
INVENTOR(S) : Peter J. Zarembo and Erland K. Persson It is certified that error appears in the above-identified patent and that said Letters Patent is hereby corrected as shown below:

Title page,
Item [56], References Cited, under U.S. PATENT DOCUMENTS, please add:

| | | | |
|---|---|---|---|
| -- 5,187,462 | 2/1993 | Montean | 335/284 |
| 5,225,807 | 7/1993 | Zhou et al. | 340/551. -- |

Please delete "5,083,122" and insert in place thereof -- 5,083,112 --.

Signed and Sealed this

Twentieth Day of August, 2002

*Attest:*

*Attesting Officer*

JAMES E. ROGAN
*Director of the United States Patent and Trademark Office*